US008811637B2

(12) United States Patent
Burns et al.

(10) Patent No.: US 8,811,637 B2
(45) **Date of Patent: *Aug. 19, 2014**

(54) METHOD AND APPARATUS FOR DETECTING USER ACTIVITIES FROM WITHIN A HEARING ASSISTANCE DEVICE USING A VIBRATION SENSOR

(75) Inventors: Thomas Howard Burns, St. Louis Park, MN (US); Matthew Green, Chaska, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 36 days.

This patent is subject to a terminal disclaimer.

(21) Appl. No.: 12/649,618

(22) Filed: Dec. 30, 2009

(65) Prior Publication Data

US 2010/0172523 A1 Jul. 8, 2010

Related U.S. Application Data

(60) Provisional application No. 61/142,180, filed on Dec. 31, 2008.

(51) Int. Cl.
*H04R 25/00* (2006.01)

(52) U.S. Cl.
USPC ..... 381/312; 381/317; 381/320; 381/328; 381/330

(58) Field of Classification Search
USPC ..... 381/312–331, 174
See application file for complete search history.

(56) References Cited

U.S. PATENT DOCUMENTS 4,598,585 A 7/1986 Boxenhorn et al.
5,091,952 A 2/1992 Williamson et al.
5,390,254 A 2/1995 Adelman
5,692,059 A * 11/1997 Kruger ..... 381/151
5,796,848 A 8/1998 Martin
6,310,556 B1 10/2001 Green et al.
6,330,339 B1 * 12/2001 Ishige et al. ..... 381/312
7,209,569 B2 4/2007 Boesen (Continued)

FOREIGN PATENT DOCUMENTS

EP 1063837 A2 12/2000
EP 2040490 B1 11/2012

(Continued)

OTHER PUBLICATIONS

Kuk, F., et al., "Ampclusion Management 101: Understanding Variables", *The Hearing Review*, (Aug. 2002), 6 pages.

(Continued)

*Primary Examiner* — Matthew Eason

(74) *Attorney, Agent, or Firm* — Schwegman, Lundberg & Woessner, P.A.

(57) ABSTRACT

The present subject matter relates to method and apparatus for processing sound by a hearing assistance device. In one example, the present subject matter is an apparatus for processing sound for a hearing assistance device, comprising: a microphone adapted for reception of the sound and to create a sound signal relating to the sound; a transducer that produces an output voltage related to motion; a signal processor, connected to the microphone and the transducer, the signal processor adapted to process the sound signal and the output voltage, the signal processor performing a vibration detection algorithm adapted to adjust hearing assistance device settings for a detected activity; and a housing adapted to house the signal processor.

20 Claims, 4 Drawing Sheets

(56) References Cited

U.S. PATENT DOCUMENTS

| | | | | |
|---|---|---|---|---|
| 7,433,484 | B2 | 10/2008 | Asseily et al. | |
| 7,778,434 | B2 | 8/2010 | Juneau et al. | |
| 8,005,247 | B2 | 8/2011 | Westerkull | |
| 2001/0007050 | A1 | 7/2001 | Adelman | |
| 2006/0029246 | A1 | 2/2006 | Boesen | |
| 2006/0159297 | A1* | 7/2006 | Wirola et al. | 381/328 |
| 2006/0280320 | A1* | 12/2006 | Song et al. | 381/174 |
| 2007/0036348 | A1 | 2/2007 | Orr | |
| 2007/0053536 | A1 | 3/2007 | Westerkull | |
| 2007/0167671 | A1* | 7/2007 | Miller, III | 600/25 |
| 2008/0205679 | A1 | 8/2008 | Darbut et al. | |
| 2010/0172529 | A1 | 7/2010 | Burns et al. | |

FOREIGN PATENT DOCUMENTS

| | | | |
|---|---|---|---|
| WO | WO-0057616 | A2 | 9/2000 |
| WO | WO-2004057909 | A2 | 7/2004 |
| WO | WO-2004092746 | A1 | 10/2004 |
| WO | WO-2006076531 | A2 | 7/2006 |

OTHER PUBLICATIONS

Kuk, F., et al., "Ampclusion Management 102: A 5-Step Protocol", *The Hearing Review*, (Sep. 2002), 6 pages.
"U.S. Appl. No. 12/233,356, Restriction Requirement mailed Aug. 18, 2011", 6 pgs.
"European Application Serial No. 08253052.8, Extended European Search Report mailed May 6, 2010", 6 pgs.
"European Application Serial No. 08253052.8, Response filed Dec. 1, 2010", 14 pgs.
"U.S. Appl. No. 12/233,356, Non Final Office Action mailed Oct. 25, 2011", 8 pgs.
"U.S. Appl. No. 12/233,356, Response filed Mar. 26, 2012 to Non Final Office Action mailed Oct. 25, 2011", 9 pgs.
"U.S. Appl. No. 12/233,356, Response filed Aug. 31, 2011 to Restriction Requirement mailed Aug. 18, 2011", 6 pgs.
"U.S. Appl. No. 12/649,634, Non Final Office Action mailed Dec. 15, 2011", 10 pgs.
U.S. Appl. No. 12/233,356 , Response filed Oct. 1, 2012 to Non Final Office Action mailed May 31, 2012, 8 pgs.
U.S. Appl. No. 12/233,356, Advisory Action mailed Oct. 12, 2012, 3 pgs.
U.S. Appl. No. 12/649,634, Advisory Action mailed Sep. 26, 2012, 3 pgs.
U.S. Appl. No. 12/649,634, Final Office Action mailed Jun. 15, 2012, 13 pgs.
U.S. Appl. No. 12/649,634, Non Final Office Action mailed Dec. 14, 2012, 18 pgs.
U.S. Appl. No. 12/649,634, Response filed Sep. 17, 2012 to Final Office Action mailed Jun. 15, 2012, 11 pgs.
"U.S. Appl. No. 12/233,356, Non Final Office Action mailed Jul. 2, 2013", 6 pgs.
"U.S. Appl. No. 12/233,356, Notice of Allowance mailed Oct. 29, 2013", 9 pgs.
"U.S. Appl. No. 12/233,356, Response filed Oct. 2, 2013 to Non Final Office Action mailed Jul. 2, 2013", 8 pgs.
"U.S. Appl. No. 12/649,634 , Response filed Oct. 15, 2013 to Final Office Action mailed Aug. 15, 2013", 11 pgs.
"U.S. Appl. No. 12/649,634, Advisory Action mailed Oct. 28, 2013", 3 pgs.
"U.S. Appl. No. 12/649,634, Examiner Interview Summary mailed Dec. 27, 2013", 3 pgs.
"U.S. Appl. No. 12/649,634, Final Office Action mailed Aug. 15, 2013", 18 pgs.
"U.S. Appl. No. 12/649,634, Response filed May 14, 2013 to Non Final Office Action mailed Dec. 14, 2012", 9 pgs.
"European Application Serial No. [Pending], Notice of Opposition mailed Aug. 6, 2013", 48 pgs.
"European Application Serial No. 12191166.3, Partial European Search Report mailed Oct. 9, 2013", 5 pgs.
"U.S. Appl. No. 12/233,356, Notice of Allowance mailed Feb. 20, 2014", 5 pgs.
"U.S. Appl. No. 12/649,634, Non Final Office Action mailed Jan. 28, 2014", 6 pgs.
"U.S. Appl. No. 12/649,634, Response Flied Jan. 15, 2014 to Final Office Action mailed Aug. 15, 2013", 9 pgs.
"European Application Serial No. 12191166.3, Extended European Search Report mailed Feb. 4, 2014", 8 pgs.

* cited by examiner

METHOD AND APPARATUS FOR DETECTING USER ACTIVITIES FROM WITHIN A HEARING ASSISTANCE DEVICE USING A VIBRATION SENSOR

RELATED APPLICATIONS

The present application claims the benefit under 35 U.S.C. 119(e) of U.S. Provisional Patent Application Ser. No. 61/142,180 filed on Dec. 31, 2008, which is hereby incorporated by reference herein in its entirety.

FIELD

This application relates generally to hearing assistance systems and in particular to a method and apparatus for detecting user activities from within a hearing aid using a vibration sensor.

BACKGROUND

For hearing aid users, certain physical activities induce low-frequency vibrations that excite the hearing aid microphone in such a way that the low frequencies are amplified by the signal processing circuitry thereby causing excessive buildup of unnatural sound pressure within the residual ear-canal air volume. The hearing aid industry has adapted the term "ampclusion" for these phenomena as noted in "Ampclusion Management 101: Understanding Variables" *The Hearing Review*, pp. 22-32, August (2002) and "Ampclusion Management 102: A 5-step Protocol" The Hearing Review, pp. 34-43, September (2002), both authored by F. Kuk and C. Ludvigsen. In general, ampclusion can be caused by such activities as chewing or heavy footfall motion during walking or running. These activities induce structural vibrations within the user's body. Another user activity that can cause ampclusion is simple speech, particularly the vowel sounds of [i] as in piece and [u] is as in rule and annunciated according to the International Phonetic Alphabet. Yet another activity is automobile motion or acceleration, which is commonly perceived as excessive rumble by passengers wearing hearing aids. Automobile motion is unique from the previously-mentioned activities in that its effect, i.e., the rumble, is generally produced by acoustical energy propagating from the engine of the automobile to the microphone of the hearing aid. Thus, there is a need in the art for a detection scheme that can reliably identify user activities and trigger the signal processing algorithms and circuitry to process, filter, and equalize their signal so as to mitigate the undesired effects of ampclusion and other user activities. Such a detection scheme should be computationally efficient, consume low power, require small physical space, and be readily reproducible for cost-effective production assembly.

SUMMARY

The present subject matter relates to method and apparatus for processing sound by a hearing assistance device. In one example, the present subject matter is an apparatus for processing sound for a hearing assistance device, comprising: a microphone adapted for reception of the sound and to create a sound signal relating to the sound; a transducer that produces an output voltage related to motion; a signal processor, connected to the microphone and the transducer, the signal processor adapted to process the sound signal and the output voltage, the signal processor performing a vibration detection algorithm adapted to adjust hearing assistance device settings for a detected activity; and a housing adapted to house the signal processor.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

Figure 1C:
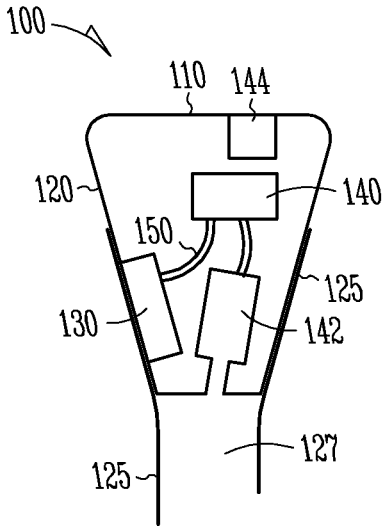
FIG. 1C shows a side cross-sectional view of an in-the-ear hearing assistance device according to one embodiment of the present subject matter.

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

There are many benefits in using the output(s) of a properly-positioned vibration sensor as the detection sensor for user activities. Consider, for example, that the sensor output is not degraded by acoustically-induced ambient noise; the user activity is detected via a structural path within the user's body. Detection and identification of a specific event typically occurs within approximately 2 msec from the beginning of the event. For speech detection, a quick 2 msec detection is particularly advantageous. If, for example, a hearing aid microphone is used as the speech detection sensor, a (≈0.8 msec) time delay would exist due to acoustical propagation from the user's vocal chords to the user's hearing aid microphone thereby intrinsically slowing any speech detection sensing. This 0.8 msec latency is effectively eliminated by the structural detection of a vibration sensor in an earmold. Considering that a DSP circuit delay for a typical hearing aid is ≈5 msec, and that a vibration sensor positively detects speech within 2 msec from the beginning of the event, the algorithm is allowed ≈3 msec to implement an appropriate filter for the desired frequency response in the ear canal. These filters can be, but are not limited to, low order high-pass filters to mitigate the user's perception of rumble and boominess.

The most general detection of a user's activities can be accomplished by digitizing and comparing the amplitude of the output signal(s) of a vibration sensor to some predetermined threshold. If the threshold is exceeded, the user is engaged in some activity causing higher acceleration as compared to a quiescent state. Using this approach, however, the sensor cannot distinguish between a targeted, desired activity and any other general motion, thereby producing "false triggers" for the desired activity. A more useful approach is to compare the digitized signal(s) to stored signature(s) that characterize each of the user events, and to compute a (squared) correlation coefficient between the real-time signal and the stored signals. When the coefficient exceeds a predetermined threshold for the correlation coefficient, the hearing aid filtering algorithms are alerted to a specific user activity, and the appropriate equalization of the frequency response is implemented. The squared correlation coefficient $\gamma^2$ is defined as:

$$\gamma^2(x) = \frac{\sum_s [f_1(s)f_2(s)] - n\overline{f_1(s)}\,\overline{f_2(s)}}{\sum_s f_1^2(s) - n\overline{f_1^2(s)}\sum_s f_2^2(s) - n\overline{f_2^2(s)}}$$

where x is the sample index for the incoming data, $f_1$ is the last n samples of incoming data, $f_2$ is the n-length signature to be recognized, and s is indexed from 1 to n. Vector arguments with overstrikes are taken as the mean value of the array, i.e., $$\overline{f_1(s)} = \frac{\sum_s f_1(s)}{n}$$

There are many benefits in using the squared correlation coefficient as the detection threshold for user activities. Empirical data indicate that merely 2 msec of digitized information (an n value of 24 samples at a sampling rate of 12.8 kHz) are needed to sufficiently capture the types of user activities described previously in this discussion. Thus, five signatures having 24 samples at 8 bits per sample require merely 960 bits of storage memory within the hearing aid. It should be noted that the cross correlation computation is immune to amplitude disparity between the stored signature $f_1$ and the signature to be identified $f_2$. In addition, it is computed completely in the time domain using basic $\{+ - \times \div\}$ operators, without the need for computationally-expensive butterfly networks of a DFT. Empirical data also indicate that the detection threshold is the same for all activities, thereby reducing detection complexity.

The sensing of various user activities is typically exclusive, and separate signal processing schemes can be implemented to correct the frequency response of each activity. The types of user activities that can be characterized include speech, chewing, footfall, head tilt, and automobile de/acceleration. Speech vowels of [i] as in piece and [u] is as in rule typically trigger a distinctive sinusoidal acceleration at their fundamental format region of a (few) hundred hertz, depending on gender and individual physiology. Chewing typically triggers a very low frequency (<10 Hz) acceleration with a unique time signature. Although chewing of crunchy objects can induce some higher frequency content that is superimposed on top of the low frequency information, empirical data have indicated that it has negligible effect on detection precision. Footfall too is characterized by low frequency content, but with a time signature distinctly different from chewing.

A calibration procedure can be performed in-situ during the hearing aid fitting process. For example, the user could be instructed during the fitting/calibration process to do the following: 1) chew a nut, 2) chew a soft sandwich, 3) speak the phrase: "teeny weeny blue zucchini", 4) walk a known distance briskly. These events are digitized and stored for analysis, either on board the hearing aid itself or on the fitting computer following some data transfer process. An algorithm clips and conditions the important events and these clipped events are stored in the hearing aid as "target" events. The vibration detection algorithm is engaged and the (4) activities described above are repeated by the user. Detection thresholds for the squared correlation coefficient and ampclusion filtering characteristics are adjusted until positive identification and perceived sound quality is acceptable to the user. The adjusted thresholds for each individual user will depend on the orientation of the vibration sensor and the relative strength of signal to noise. For the walking task, the sensor can be calibrated as a pedometer, and the hearing aid can be used to inform the user of accomplished walking distance status. In addition, head tilt could be calibrated by asking the user to do the following from a standing or sitting position looking straight ahead: 1) rotate the head slowly to the left or right, and 2) rotate the head such that the user's eyes are pointing directly upwards. These events are digitized as done previously, and the accelerometer output is filtered, conditioned, and differentiated appropriately to give an estimate of head tilt in units of mV output per degree of head tilt, or some equivalent. This information could be used to adjust head related transfer functions, or as an alert to a notify that the user has fallen or is falling asleep.

It is understood that a vibration sensor can be employed in either a custom earmold in various embodiments, or a standard earmold in various embodiments. Although specific embodiments have been illustrated and described herein, it will be appreciated by those of ordinary skill in the art that other embodiments are possible without departing from the scope of the present subject matter.

Figure 5:
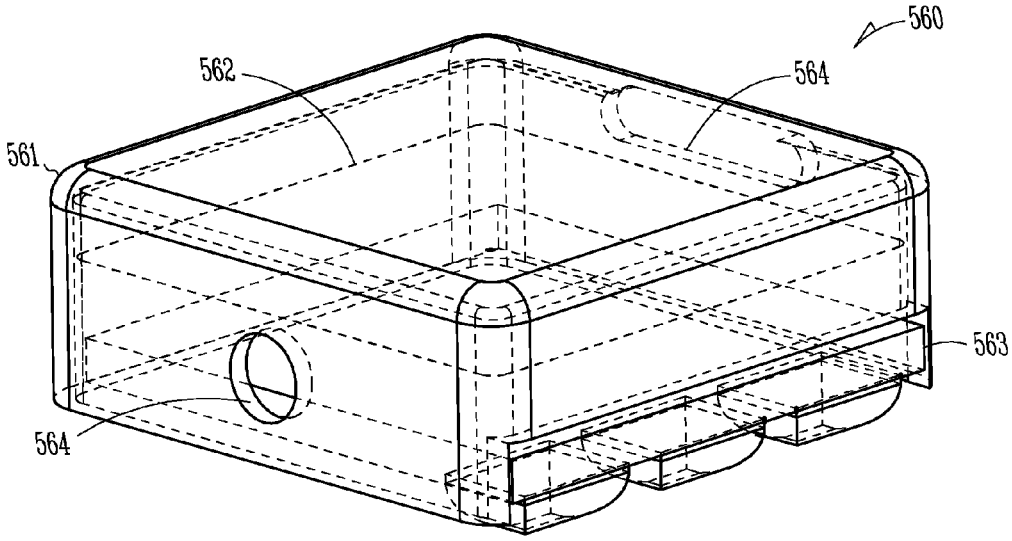
FIG. 5 shows a vibration sensor according to one embodiment of the present subject matter.

FIG. 5 shows a vibration sensor 560 according to one embodiment of the present subject matter. The sensor includes a case 561, a diaphragm electrode 562 suspended within the case, and an stationary electrode opposite the diaphragm 563. The case includes orifices 564 on each side of the diaphragm. The orifices 564 expose the diaphragm 563 to the external environment. The sensor monitors voltage of the capacitor formed by the diaphragm and the stationary electrode. An electric field is established between the diaphragm and the stationary electrode. Vibration causes the diaphragm to move. The movement of the diaphragm changes the capacitance of the diaphragm and the electrode. The change in capacitance alters the electric field and thus the voltage between the diaphragm and the electrode. The voltage signal provides an indication of vibration detected by the diaphragm of sensor.

FIG. 1C shows a side cross-sectional view of an in-the-ear (ITE) hearing assistance device according to one embodiment of the present subject matter. It is understood that FIG. 1C is intended to demonstrate one application of the present subject matter and that other applications are provided. FIG. 1C relates to the use of a vibration sensor mounted rigidly to the inside shell of an ITE (in-the-ear) hearing assistance device. However, it is understood that a vibration sensor according to the present subject matter may be used in other devices and applications. One example is the earmold of a BTE (behind-the-ear) hearing assistance device, as demonstrated by FIG. 2. The present vibration sensor design may be employed by other hearing assistance devices without departing from the scope of the present subject matter.

Figure 1A:
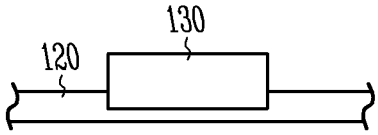
FIG. 1A illustrates a vibration sensor mounted halfway into the shell of a hearing assistance device according to one embodiment of the present subject matter.
Figure 1B:
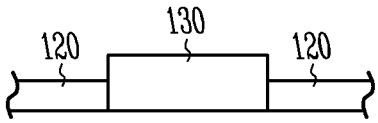
FIG. 1B illustrates a vibration sensor mounted flush with the shell of a hearing assistance device according to one embodiment of the present subject matter.

The ITE device 100 of the embodiment illustrated in FIG. 1C includes a faceplate 110 and an earmold shell 120 which is positioned snugly against the skin 125 of a user's ear canal 127. A vibration sensor 130 is rigidly mounted to the inside of an earmold shell 120 and connected to the hybrid integrated electronics 140 with electrical wires or a flexible circuit 150. The electronics 140 include a receiver (loudspeaker) 142 and microphone 144. Other placements and mountings for vibration sensor 130 are possible without departing from the scope of the present subject matter. In various embodiments, the vibration sensor 130 is partially embedded in the plastic of earmold shell 120 as shown in FIG. 1A, or fully embedded in the plastic so that is it flush with the exterior of earmold shell 120 as shown in FIG. 1B. With this approach, structural waves are detected by sensor 120 via mechanical coupling to the skin 125 of a user's ear canal 127. An analogous electrical signal is sent to electronics 140, processed, and used in an algorithm to detect various user activities. It is understood that the electronics 140 may include known and novel signal processing electronics configurations and combinations for use in hearing assistance devices. Different electronics 140 may be employed without departing from the scope of the present subject matter. Such electronics may include, but are not limited to, combinations of components such as amplifiers, multi-band compressors, noise reduction, acoustic feedback reduction, telecoil, radio frequency communications, power, power conservation, memory, multiplexers, analog integrators, operational amplifiers, and various forms of digital and analog signal processing electronics. It is understood that the vibration sensor 130 shown in FIG. 1C is not necessarily drawn to scale. Furthermore, it is understood that the location of the vibration sensor 130 may be varied to achieve desired effects and not depart from the scope of the present subject matter. Some variations include, but are not limited to, locations on faceplate 110, sandwiched between receiver 142 and earmold shell 120 so as to create a rigid link between the receiver and the shell, or embedded within the hybrid integrated electronic circuit 140. In one variation the vibration sensor is mounted at the tip of an ITE hearing assistance device such that the sensor is just around the first bend of the ear canal.

Figure 2:
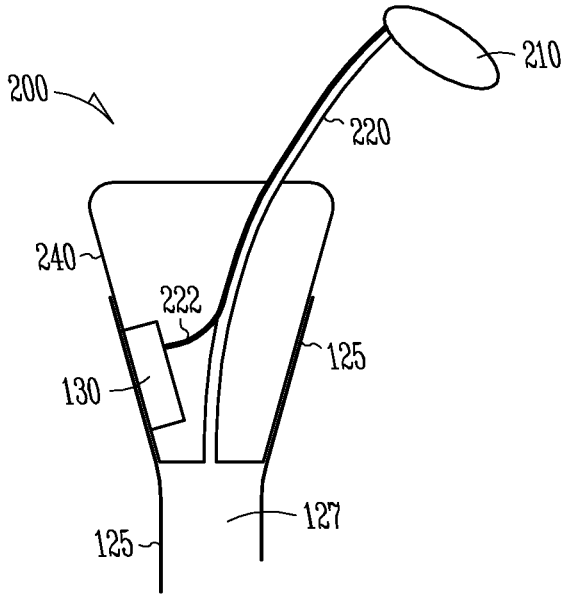
FIG. 2 shows a vibration sensor mounted to an interior surface of a earmold housing according to one embodiment of the present subject matter.

FIG. 2 shows a hearing assistance system 200 and illustrates a vibration sensor mounted to an interior surface of a earmold housing 240 according to one embodiment of the present subject matter. The earmold 240 includes a connection to a BTE (behind-the-ear) hearing assistance device 210. The BTE 210 delivers sound through sound tube 220 to the ear canal 127 through the housing 240. Sound tube 220 also contains an electrical conduit 222 for wired connectivity between the BTE and the vibration sensor 130. The remaining operation of the device is largely the same as set forth for FIG. 1C, except that the BTE 210 includes the microphone and electronics, and earmold 240 contains the sound tube 220 with electrical conduit 222 and vibration sensor 130. The entire previous discussion pertaining to variations for the apparatus of FIG. 1C applies herein for FIG. 2. Other embodiments are possible without departing from the scope of the present subject matter.

Figure 3:
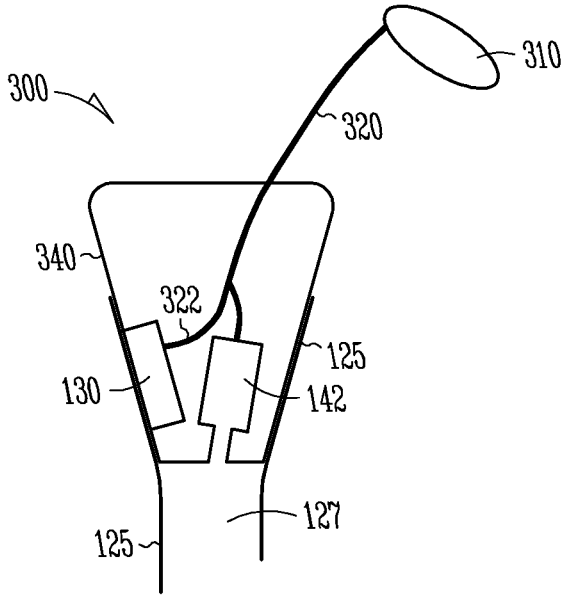
FIG. 3 illustrates a BTE providing an electronic signal to an earmold having a receiver according to one embodiment of the current subject matter.

The embodiment of FIG. 3 uses a BTE 310 to provide an electronic signal to an earmold 340 having a receiver 142. This variation permits a wired approach to providing the acoustic signals to the ear canal 142. The electronic signal is delivered through electrical conduit 320 which splits at 322 to connect to vibration sensor 130 and receiver 142.

Figure 4:
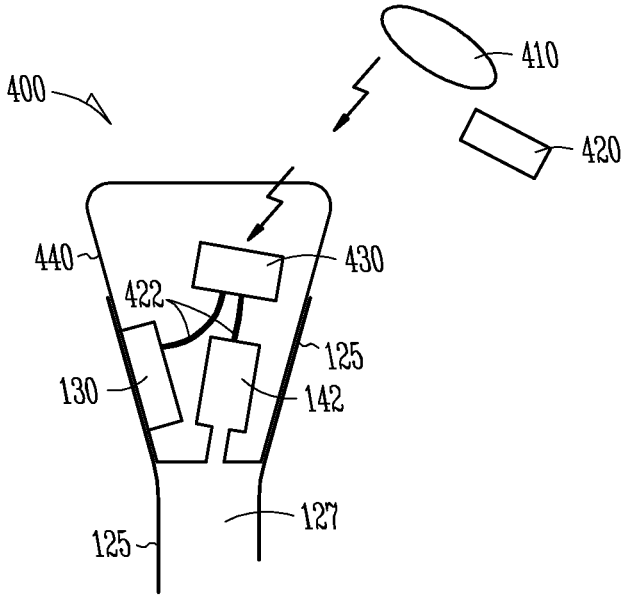
FIG. 4 illustrates a wireless earmold embodiment of the current subject matter.

The embodiment of FIG. 4, a wireless approach is employed, such that the earmold 440 includes a wireless apparatus for receiving sound from a BTE 410 or other signal source 420. Such wireless communications are possible by fitting the earmold with transceiver electronics 430 and power supply. The electronics 430 could connect to a receiver loudspeaker 142. In bidirectional applications, it may be advantageous to fit the earmold with a microphone to receive sound using the earmold. It is understood that many variations are possible without departing from the present subject matter.

In various embodiments, a vibration sensor according to the present subject matter is fabricated from an electret microphone. The microphone is modified by adding orifices in the microphone case to more fully expose the microphone diaphragm to the external environment. Fuller exposure of the diaphragm reduces dampening and increases the sensitivity of the diaphragm to vibration. In various embodiments, the total surface area of the orifices is distributed between multiple orifices. A PULSE 6000 electret microphone is an example of an electret microphone that can be modified to detect vibration including, but not limited to, vibration from speech and chewing.

Figure 6:
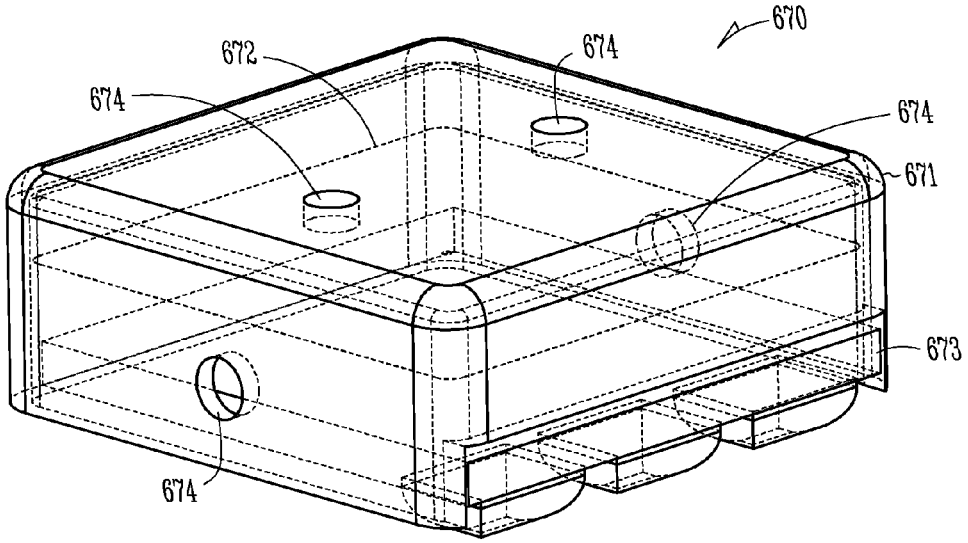
FIG. 6 shows a $1^{st}$ order, differential, directional electret microphone vibration sensor according to one embodiment of the present subject matter.

FIG. 6 shows a $1^{st}$ order, differential, directional electret microphone vibration sensor 670 according to one embodiment of the present subject matter. The microphone includes a case 671, a diaphragm electrode 672 suspended within the case, and an electret coated surface 673 opposite the diaphragm. The electret coated surface 673 provides charge to the capacitor formed by the diaphragm 672 and the surface 673. As the diaphragm moves in response to vibration, the voltage between the diaphragm and the electret coated surface varies according to the detected vibration. In various embodiments, the sensor includes an amplifier to increase resolution of the detected vibration signal. The microphone case is modified to include orifices 674 on each side of the diaphragm. The orifices 674 expose the diaphragm 672 to the external environment. The orifices 674 can be of any shape as long as they are sufficiently large. In various embodiments, each orifice has a cross sectional area of between 0.03 $mm^2$ and 12 $mm^2$. In some embodiments, an orifice comprises a cross sectional area of 0.4 $mm^2$. FIG. 6 shows the total surface area of case 671 with the distance between two orifices on one side of the diaphragm. It is understood that other directional electret microphones may be used to fabricate a vibration sensor without departing from the scope of the present subject matter including but not limited to, cardioids, super-cardioids, hyper-cardioids and bi-directional microphones.

In various embodiments, an omni-directional electret microphone is used to fabricate a vibration sensor according to one embodiment of the present subject matter. Such a microphone should have a sufficiently large sound orifice. The orifice is used to further expose the diaphragm of the microphone to the external environment. The orifice can have any shape. In various embodiments, the omni-directional electret microphone is mounted inside the shell and at the tip of an ITE with the orifice open to the interior of the ITE. In some embodiments, the orifice has a PULSE C-barrier type of cover to keep debris out of the microphone. In an embodiment, the surface area of the orifice is about 0.5 $mm^2$. In various embodiments, the surface area of the orifice is between about 0.03 $mm^2$ and about 12 $mm^2$. It is understood that use of other of types of microphones for making vibration sensors are possible without departing from the scope of the present subject matter including piezoceramic microphones and moving-coil dynamic microphones. In addition to microphones, any transducer could be used that produces an output voltage analogous to transducer bending and/or motion. Piezo films or nanofibers are an example.

The present subject matter includes hearing assistance devices, including but not limited to, cochlear implant type hearing devices, hearing aids, such as in-the-ear (ITE), in-the-canal (ITC), completely-in-the-canal (CIC), behind-the-ear (BTE), and receiver-in-the-ear (RIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising:

a first microphone configured to receive a sound and to create a sound signal relating to the sound;

a transducer configured to produce an output voltage related to motion, the transducer including a second microphone being an electret microphone;

a signal processor connected to the first microphone and the transducer, the signal processor configured to process the sound signal and the output voltage and to perform a vibration detection algorithm adapted to determine a correlation between the output voltage and each signature signal of predetermined signature signals characterizing activity types and adjust hearing assistance device settings for an activity type of the activity types detected from the output voltage in response the correlation exceeding a threshold, the activity types including at least one non-speech activity type; and a housing adapted to house the signal processor.

2. The device of claim 1, wherein the electret microphone comprises an omni-directional electret microphone.

3. The device of claim 2, comprising an in-the-ear (ITE) hearing assistance device having a tip and an interior, and wherein the electret microphone includes an orifice and is mounted inside the housing and at the tip of the ITE hearing assistance device with the orifice open to the interior of the ITE hearing assistance device.

4. The device of claim 3, wherein the orifice has a surface area between about 0.03 $mm^2$ and about 12 $mm^2$.

5. The device of claim 1, wherein the electret microphone comprises a directional electret microphone including:

a case;

a diaphragm suspended within the case; and an electret coated surface opposite the diaphragm.

6. The device of claim 5, wherein the case comprises orifices on each side of the diaphragm.

7. The device of claim 6, wherein the orifices each have a cross sectional area between about 0.03 $mm^2$ and about 12 $mm^2$.

8. The device of claim 1, comprising an in-the-ear (ITE) hearing assistance device including the first microphone, the transducer, the signal processor, and the housing.

9. The device of claim 8, wherein the ITE hearing assistance device comprises an earmold shell, and the transducer is mounted to the earmold shell.

10. The device of claim 8, wherein the ITE hearing assistance device comprises a tip, and the transducer is mounted at the tip.

11. The device of claim 8, wherein the ITE hearing assistance device comprises a faceplate, and the transducer is mounted on the faceplate.

12. The device of claim 8, wherein the ITE hearing assistance device comprises an earmold shell and a receiver, and the transducer is sandwiched between the earmold shell and the receiver to create a rigid link between the earmold shell and the receiver.

13. The device of claim 8, wherein the ITE hearing assistance device comprises an integrated electronic circuit, and the transducer is embedded within the integrated electronic circuit.

14. The device of claim 1, comprising a behind-the-ear (BTE) hearing assistance device including the first microphone and the signal processor, and wherein the housing comprises an earmold connected to the BTE hearing assistance device.

15. The device of claim 14, wherein the earmold has an interior, and the transducer is mounted to the interior of the earmold.

16. The device of claim 14, comprising a wired electrical connection between the earmold and the BTE hearing assistance device.

17. The device of claim 14, comprising a wireless electrical connection between the earmold and the BTE hearing assistance device.

18. The device of claim 1, wherein the electret microphone comprises:

a case;

a diaphragm suspended within the case;

an electret coated surface opposite the diaphragm; and a plurality of orifices in the case.

19. The device of claim 18, wherein the signal processor is configured to detect speech and non-speech activities.

20. The device of claim 19, wherein the signal processor is configured to detect chewing.

* * * * *